United States Patent [19]

Staten et al.

[11] Patent Number: 4,779,174

[45] Date of Patent: Oct. 18, 1988

[54] SUBMERSIBLE LIGHTING DEVICE

[76] Inventors: Carlton F. Staten; Remelle Staten, both of 26 Nook Farms Rd., Windsor, Conn. 06095

[21] Appl. No.: 860,876

[22] Filed: May 8, 1986

[51] Int. Cl.[4] ..... F21L 7/00

[52] U.S. Cl. ..... 362/158; 362/184; 362/267

[58] Field of Search ..... 362/267, 184, 158, 235, 362/243, 300, 375, 293, 157, 186, 198; 43/17.5

[56] References Cited

U.S. PATENT DOCUMENTS

| | | | |
|---|---|---|---|
| 1,974,832 | 9/1934 | Peterson | 43/17.5 |
| 2,203,894 | 6/1940 | Cooke | 362/267 |
| 2,431,091 | 11/1947 | Thomas | 362/184 |
| 2,908,101 | 10/1959 | Butler et al. | 362/158 |
| 3,302,014 | 1/1967 | Moore et al. | 362/267 |
| 3,617,733 | 11/1971 | Adams | 362/267 |
| 3,836,762 | 9/1974 | Thomason | 362/198 |
| 4,088,880 | 5/1978 | Walsh | 362/96 |
| 4,394,716 | 7/1983 | Campagna et al. | 362/267 |
| 4,429,350 | 1/1984 | Guthrie | 362/186 |
| 4,503,563 | 3/1985 | Johnson | 362/158 |

*Primary Examiner*—Michael Koczo
*Assistant Examiner*—D. M. Cox
*Attorney, Agent, or Firm*—CTC & Associates

[57] ABSTRACT

This invention is concerned with a submersible illuminating device useful as a point of orientation for underwater swimmers, lighting means for swimming pool and the like.

1 Claim, 2 Drawing Sheets

SUBMERSIBLE LIGHTING DEVICE

BACKGROUND OF THE INVENTION

The present invention is concerned with a lighting device submersible in water to provide illumination, orientation and safety for swimming pools, lakes, or other bodies of water frequented by swimmers, especially by persons swimming under water. By means of a floatation adapter, the lighting device of the instant invention may also be caused to float on the surface of water in an upside down manner in order to provide illumination of the space below.

There are several references of interest which concern themselves with light sources in an aqueous environment, namely, U.S. Pat. No. 3,443,085 (Steltzer et al) describes a buoy light designed to float in the water in an upright position so as to be noticable by the mariner, for instance, along an inland waterway. Submersion or under water light operation is nowhere contemplated or desired.

U.S. Pat. No. 4,234,913 (Ramme) deals with a lighted bobber for a fishing line so as to make the location of the line visible in the dark. Such lighted bobber is incapable to provide illumination or direction under water.

U.S. Pat. No. 4,532,178 (Uke) discloses a diver's flashlight providing a strongly focused coherent light beam, and it is not designed to illuminate broadly an underwater space.

None of the above mentioned references provide or even anticipate the submersible lighting device of this invention. It is also known that underwater lighting may be provided for swimming pools and the like, such lighting usually being installed permanently and illuminated conventional (e.g. 110 Volt) light bulb, however, depending on materials of construction, manner of installation and maintenance such lighting may be hazardous to swimmers with possible catastrophic consequences.

SUMMARY OF THE INVENTION

The submersible lighting device of this invention has considerable versatility and uses which are neither provided by devices suggested in the references of interest nor is such a device found as an item of commerce.

It is therefore an object of this invention to provide means for lighting under water space;

It is another object of this invention to provide multicolored illumination below the water surface;

It is a further object of this invention to provide the swimmer under water with means for direction and/or orientation;

It is still another object of this invention to provide illumination for a swimming pool, lake or other water body; Still a further object of this invention comprises providing the lighting device of this invention for the purpose of having it temporarily affixed to the bottom or to the side of a body of water such as a swimming pool.

It is still a further object of this invention to provide illumination in an aqueous environment which is safe for swimmers.

Other objects of this invention shall become apparent by the disclosure and claims.

DETAILED DESCRIPTION OF THE INVENTION

Figure 1:
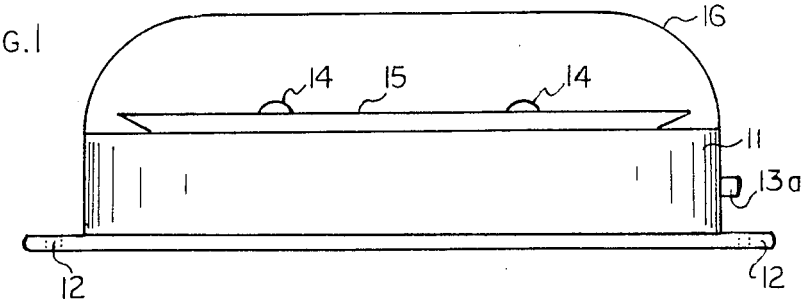
FIG. 1 is a side elevated view of an embodiment of this invention.

FIG. 1 illustrates a housing 11 having extended rim 12, a power switch 13 is mounted on the side of the housing, and a reflector disc 15 as well as two electrical light bulbs 14 are visible given an indication that light is being cast not only 360 degrees in the horizontal but also over an arc of more than 180 degrees; the housing is covered by the translucent dome 16; dome and housing are firmly held together by a suitable number of nuts and bolts or screws as is shown in other drawings; also, gasketing is provided in crucial areas to enhance resistance to water penetration.

Figure 2:
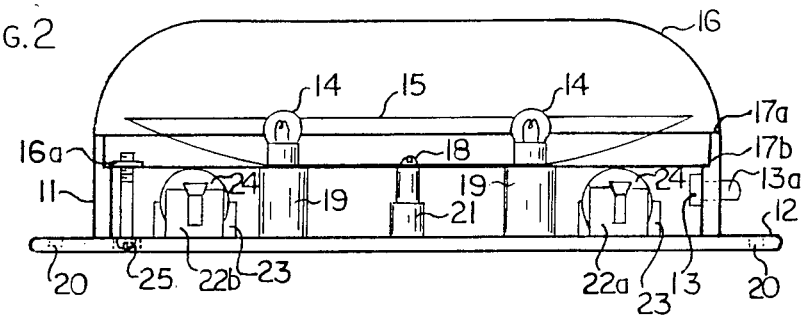
FIG. 2 is as FIG. 1 except that the sides of the housing and deflector have been cut away.

For instance, FIG. 2 provides an illustration of the housing 11 including extended rim 12, which is covered by dome 16, both capable of being rigidly connected with a multiplicity of bolts 25 (one only shown) being solidly engaged with dome 16 by means of angled portions **16*a* (one only shown) of dome 16, and housing 11 being sealed by upper gasket 17*a* and lower gasket 17*b*. Illumination means are provided by light bulbs 14 fitted into support columns 19 from where the necessary electrical connections are leading either directly, or via switch 13, to batteries 24, the latter resting in cradles 23 on the sides, the minus (−) tops 22*a* and plus (+) bottoms 22*b* of the batteries 24 being held in place by spring loaded contact means; the housing 11 is further equipped with reflector 15 which is secured by bolt 18 to central support post 21. It will be appreciated that it is opportune to provide the reflector 15 with openings big enough so that upon removal of the dome 16, detaching the reflector may not be restricted by light bulbs 14, facilitating easy access to batteries 24** for testing or exchange.

Figure 3:
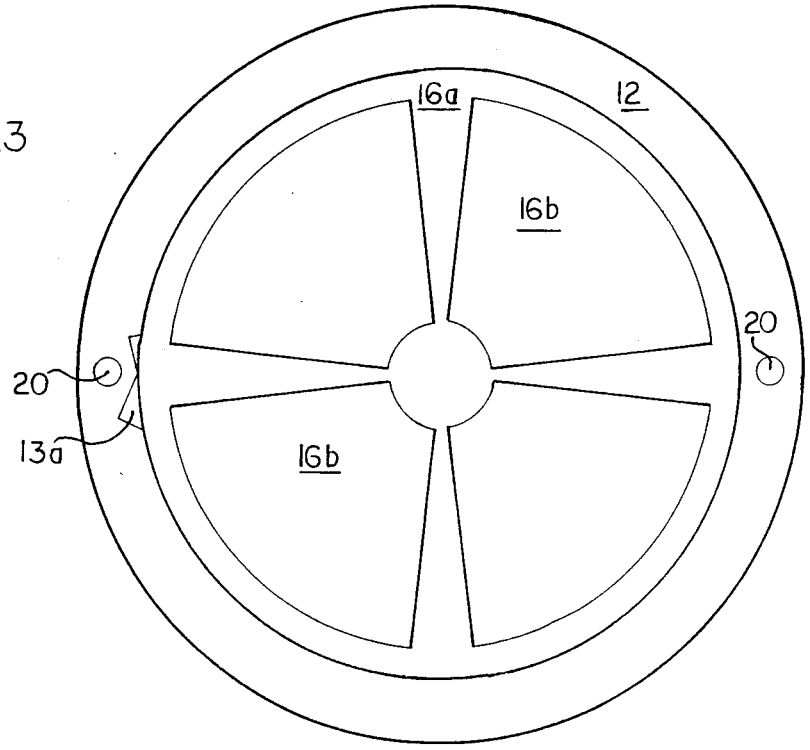
FIG. 3 is a plan view of a device of this invention having multicolored translucent cover.

FIG. 3 is a top view of an embodiment of this invention comprising the dome 16 having translucent sections **16*b* and opaque section 16*a*; the translucent sections may be clear or of one or more colors such as red, green, blue, white, etc.; also represented is the extended rim 12 having a multiplicity of openings 20 enabling the user to either mount the device of this invention against the side of a swimming pool or the like, or to attach thereto suitable line or rope in order to hold the device in a predetermined location be it on the bottom of a swimming pool or at the surface of the water; activating switch 13*a*** can also be seen.

Figure 4:
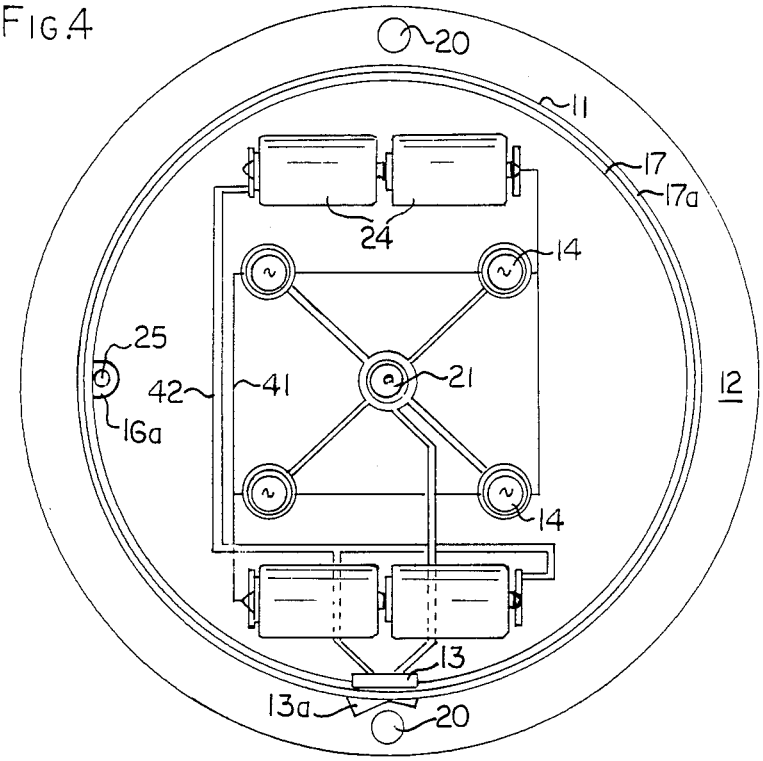
FIG. 4 is as FIG. 3 except in the absence of reflector and cover.

FIG. 4 provides an outline of simple electrical circuitry for a device of this invention, namely batteries 24, two of each being positioned in series, the respective minus (−) poles being linked together and leading to switch 13 and from there to center star connection located around central support post 21 and from there to each individual light bulb support 19 carrying light bulbs 14; light bulbs 14 may be turned on or off by pressing switch lever 13*a* towards the desired position; the respective plus (+) poles are combined and are leading directly to support posts 19 enabling closing of circuit.

Figure 5:
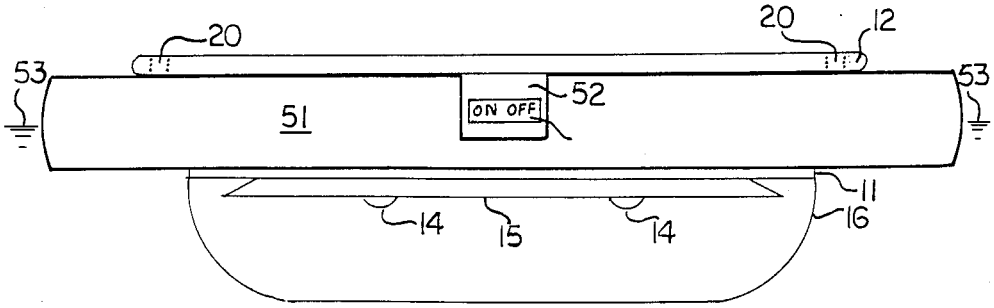
FIG. 5 provides an elevated side view of an embodiment of this invention simulating an arrangement of the device floating on the surface of water.

FIG. 5 demonstrates the use of a device of this invention on the surface of water by being cradled upside down in ring or donut shaped flotation device 51, held in place by extended rim 12; device 51 has cut out section 52 in order to provide free access to switch lever 13*a;* approximate depth of the illuminating device is indicated by wave lines 53; it is apparent that through dome 16, the light from light bulbs 14 may extend light not only to the reflector 15 causing light to be transmitted in a more downward direction, but also light may reach over the edge of said reflector to provide illumination at an arc of at least 180 degrees.

It should be understood that the configuration of the submersible lighting device of this invention is not critical and may be elliptical, square, hexagonal, octogonal or the like, provided that there are no sharp corners or edges which may cause injury to a swimmer; preferably such a device should have a circular shape; the height of the device of this invention may also vary depending on materials used, the lighting means employed, the size of the device, ornamental considerations, etc.; the housing may be constructed from metals such as aluminum, stainless steel or galvanized steel, but is preferably made from plastic such a poly(vinyl chloride), polyacrylates, (impact resistant) polystyrene, graft polymers such as polybutadiene or poly(butadiene-styrene) rubber grafted with styrene and/or acrylonitrile; also polyacetal, polycarbonate, polysulfone, polyamide, polyester and the like, whereas the dome may be manufactured from the above mentioned materials, the translucent sections being preferably made from poly(methacrylate), poly(methyl methacrylate), clear polystyrene and the like; electrical connections may be accomplished by having circuitry imprinted on the housing, or by using suitable wiring made from insulated copper or aluminum wires or a combination thereof.

It is essential that the electrical switch be either water resistant or be protected from direct contact with water by a flexible membrane as is well known to the art. For the seals between dome and housing may be used elastomers such as polychloroprene, poly(butadiene-acrylonitrile), poly(butadiene-styrene), polybutadiene, polyisoprene, butyl rubber and the like, either unfoamed or expanded to a closed cell foam; polychloroprene is a preferred material.

Power for the illuminating means may be provided by one or more (rechargeable) batteries connected parallel or in series or a combination thereof, powering 1–10 or more, preferably 1–8 and usually 1–6 light bulbs. Switching means may be installed which will allow activating selected light bulbs, or circuitry may be chosen that causes automatic rhythmic off-and-on switching of the light(s), providing as entertaining effect especially when a multicolored dome is used. However, the aspect of safety provided by the lighting device of this invention ought not to be underestimated, whereby such a device may provide direction or a rallying point for (scuba) divers, reduce disorientation to the novice to underwater swimming at night, or may serve as a lighting or direction marker for an item fallen overboard.

It should be understood that the instant description and drawings are for the purpose of illustration only; any modifications, equivalents and variations are considered to fall within the scope of the appended claims.

What is claimed is:

1. A submersible lighting device for providing illumination in an aqueous environment comprising a substantially flat, circular housing carrying illuminating means including a plurality of light bulbs, electrical circuitry for said light bulbs, a water tight switch and a single, circular, essentially convex shaped reflector centrally secured to said housing; and a translucent cover enclosing said illumination means and said reflector, and being attached to said housing in a water tight fashion; said lighting device having a specific gravity greater than that of water and being equipped with means for attaching it to or holding it in a predetermined location, and a removable ring shaped flotation device for circumferentially cradling said lighting device only in an inverted position on the surface of the water so that the translucent cover is submerged, and when the flotation device is removed the lighting device can be used in an upright and sideways orientation.

* * * * *